US010451328B2

(12) United States Patent
Bertolini et al.

(10) Patent No.: US 10,451,328 B2
(45) Date of Patent: Oct. 22, 2019

(54) REFRIGERATOR WITH ICE BUCKET ON DOOR

(71) Applicant: Electrolux Home Products, Inc., Charlotte, NC (US)

(72) Inventors: Nilton Carlos Bertolini, Chonburi (TH); Thomas McCollough, Anderson, SC (US); Travis McMahan, Honea Path, SC (US); Jorge Carlos Montalvo Sanchez, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 27 days.

(21) Appl. No.: 15/649,750

(22) Filed: Jul. 14, 2017

(65) Prior Publication Data

US 2017/0307277 A1 Oct. 26, 2017

Related U.S. Application Data

(63) Continuation of application No. 14/538,504, filed on Nov. 11, 2014, now Pat. No. 9,709,312.

(51) Int. Cl.
*F25C 5/187* (2018.01)
*F25D 23/04* (2006.01)
(Continued)

(52) U.S. Cl.
CPC ..... *F25C 5/187* (2013.01); *F25C 5/185* (2013.01); *F25C 5/22* (2018.01); *F25D 23/04* (2013.01); *F25C 2700/02* (2013.01)

(58) Field of Classification Search
CPC .. F25C 5/185; F25C 5/187; F25C 5/22; F25C 2700/02; F25D 23/04
(Continued)

(56) References Cited

U.S. PATENT DOCUMENTS 5,474,213 A 12/1995 Unger
6,050,097 A 4/2000 Nelson
(Continued)

FOREIGN PATENT DOCUMENTS

CN 1769822 5/2006
CN 202153084 2/2012
(Continued)

OTHER PUBLICATIONS

Partial International Search Report for PCT/EP2015/060059 dated Jan. 27, 2016.
(Continued)

*Primary Examiner* — Marc E Norman
(74) *Attorney, Agent, or Firm* — Pearne & Gordon LLP

(57) ABSTRACT

A refrigerator with a freezer compartment having a door to open and close the freezer compartment. An ice maker is disposed within the freezer compartment for forming ice pieces. An ice storage bin is mounted to the door for receiving ice from the ice maker. A cover is hinged to the ice marker. The cover is moveable between an unrestricting position in which ice is discharged when the door is in a closed position to a restricting position in which ice does not discharge when the door is in an open position. A sliding tray having sidewall enclosing an area behind the ice maker and extending the depth between the ice maker and a rear wall of the refrigerator, defines a storage chamber.

10 Claims, 7 Drawing Sheets

(51) Int. Cl.
*F25C 5/20* (2018.01)
*F25C 5/185* (2018.01)

(58) Field of Classification Search
USPC ..... 62/131, 137
See application file for complete search history.

(56) References Cited

U.S. PATENT DOCUMENTS

| | | | | |
|---|---|---|---|---|
| 7,900,465 | B2 | 3/2011 | Wetekamp | |
| 7,946,125 | B2 | 5/2011 | Visin et al. | |
| 2003/0172664 | A1* | 9/2003 | Collins | F25C 5/187 62/137 |
| 2007/0125101 | A1* | 6/2007 | Maglinger | F25C 5/20 62/137 |
| 2010/0257889 | A1 | 10/2010 | Lee | |
| 2010/0307187 | A1 | 12/2010 | Kwon et al. | |
| 2011/0138842 | A1 | 6/2011 | Chase et al. | |

FOREIGN PATENT DOCUMENTS

| | | |
|---|---|---|
| CN | 102388280 | 3/2012 |
| CN | 102782425 | 11/2012 |
| CN | 202770095 | 3/2013 |
| EP | 1653178 | 5/2006 |
| JP | 2002310549 | 10/2002 |

OTHER PUBLICATIONS

International Search Report and Written Opinion for Corresponding Application No. PCT/US2015/060059; dated May 3, 2016.
CN OA for application No. 201580062210.6, dated Apr. 22, 2019, 12 pages.

* cited by examiner

REFRIGERATOR WITH ICE BUCKET ON DOOR

This application is a continuation of U.S. application Ser. No. 14/538,504 filed on Nov. 11, 2014. This application is incorporated herein by reference.

BACKGROUND

Technical Field

The application relates generally to an ice making system for a refrigerator, and more particularly, to an ice making and storage system in a freezer compartment of a refrigerator wherein an ice storage bin is mounted to a refrigerator door.

Description of Related Art

Generally, ice making systems include an ice maker mounted within the freezer compartment of a refrigerator and an ice storage receptacle or bin supported beneath the ice maker for receiving the formed ice from the ice maker. The ice maker is commonly mounted within the freezer compartment adjacent the side or rear wall of the freezer compartment such that water and power can be readily supplied to the ice maker.

Often, the ice storage receptacle is supported by a shelf structure beneath the ice maker within the freezer compartment. The ice storage receptacle generally extends across the freezer compartment and has a front end adjacent the freezer door. A sensor is commonly provided for sensing the level of ice disposed in the ice storage bin such that ice pieces are produced when insufficient ice is in the storage bin and ice pieces are not produced when the ice storage bin is filled.

Typically, ice making and dispensing systems occupy a relatively large amount of freezer space. In particular, the ice storage bin extends across the freezer compartment and occupies a large amount of freezer compartment space. This is usually perceived as a disadvantage by many consumers who generally prefer to have more available shelf and storage space.

SUMMARY

The following presents a simplified summary in order to provide a basic understanding of some example aspects described in the detailed description.

A refrigerator having a compartment includes a door configured to open and close at least a portion of the compartment, an ice making assembly disposed within the compartment, the ice making assembly having an ice maker for forming ice pieces, and a cover rotatably hinged to the ice marker, wherein the cover is moveable between an unrestricting position in which ice is discharged, to a restricting position in which ice does not discharge; and an ice storage unit removably mounted to the door for receiving ice from the ice making assembly, wherein at least a portion of the ice storage unit is configured to be positioned under the ice making assembly when the door is in a closed position.

The refrigerator has a bail arm rotatable mounted to the ice maker for sensing the level of ice within the ice storage unit and the bail arm is operatively configured to inhibit the ice maker from forming ice pieces when the ice storage unit is full.

The cover is rotatably hinged to a side wall of the ice maker. The cover rotates about a horizontal axis relative to the ice maker. The cover in the unrestricting position engages a top edge of the ice storage unit.

A storage chamber is positioned behind the ice maker, the storage chamber having a tray slidably mounted to the storage chamber. The tray has a curved guide configured to slidably engage with the storage chamber, the curved guide being disposed along a side wall of the tray. The curved guide defines a curved path when the tray slides in and slides out of the storage chamber.

An ice making system for a refrigerator includes an ice maker for forming ice pieces configured for being disposed within the refrigerator; a cover rotatably mounted to the ice marker, the cover being rotatable between a restricting position in which ice does not discharge and an unrestricting position in which ice is discharged; and an ice storage unit removably mounted to the door for receiving ice from the ice maker, wherein at least a portion of the ice storage unit is configured to be positioned under the ice maker.

A bail arm is rotatably mounted to the ice maker for sensing the level of ice within the ice storage unit. The bail arm is operatively configured to inhibit the ice maker from forming ice pieces when the ice storage unit is full.

A refrigerator having a compartment includes a door configured to open and close at least a portion of the compartment; an ice maker disposed within the compartment for forming ice pieces; a bail arm rotatably mounted to the ice maker for sensing the level of ice within the ice storage unit; a cover rotatably mounted to the ice maker, the cover being rotatable between a restricting position in which ice does not discharge when the door is in an open position and an unrestricting position in which ice is discharged when the door is in a closed position; and an ice storage unit removably mounted to the door for receiving ice from the ice maker, wherein at least a portion of the ice storage unit is configured to be positioned under the ice maker when the door is in a closed position.

A storage chamber is arranged behind the ice maker, the storage chamber having a tray slidably mounted to the storage chamber for extension and retraction of the tray to store refrigerated items. The tray has a pair of curved guide disposed along opposing side wall of the tray, the curved guides defining a curved path for the tray to slide in and slide out of the storage chamber without interfering with the ice maker. The tray has a front edge adapted to serve as a handle for defining a curved path when the tray slides in and slides out of the storage chamber.

A refrigerator having a compartment includes a door configured to open and close at least a portion of the compartment, an ice making assembly disposed within the compartment, the ice making assembly having an ice maker for forming ice pieces; an ice storage unit removably mounted to the door for receiving ice from the ice making assembly, wherein at least a portion of the ice storage unit is configured to be positioned under the ice making assembly when the door is in a closed position; and a slidable tray defining a storage space behind the ice making assembly, the tray being slidable from a closed position for storing items behind the ice making assembly and an accessible position allowing access to the chamber.

This summary is not an extensive overview of the features and systems discussed herein. It is not intended to identify key/critical elements or to delineate the scope of such features and systems. Its sole purpose is to present some concepts in a simplified form as a prelude to the more detailed description.

BRIEF DESCRIPTION OF THE DRAWINGS

The foregoing and other aspects of the described embodiments will become apparent to those skilled in the art upon reading the following description with reference to the accompanying drawings, in which.

DESCRIPTION OF EXAMPLES OF EMBODIMENTS

Figure 1:
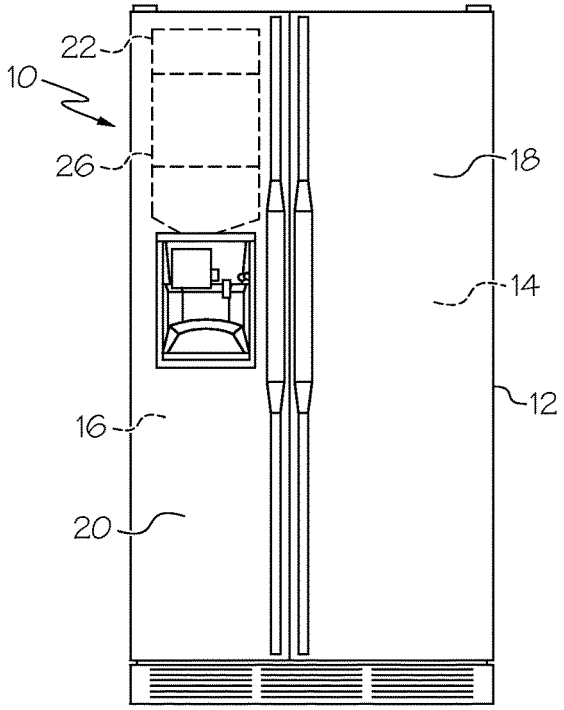
FIG. 1 is a front view of an exemplary embodiment of a refrigerator with a side-by-side configuration having an ice making and dispensing system.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Turning to FIG. 1, a refrigerator 10, illustrating a side-by-side configuration is shown. The refrigerator 10 having a cabinet 12 forming a fresh food compartment 14 and a freezer compartment 16. Both the fresh food compartment 14 and the freezer compartment 16 are provided with access openings. A fresh food door 18 restricts access to the fresh food compartment 14. A freezer door 20 restricts access to a freezer compartment 16. Both the fresh food door 18 and the freezer door 20 are hingedly mounted to the cabinet 12 for opening and closing the access openings. The freezer door 20 can be operably coupled to the ice dispensing system 26 whereby a user may readily dispense ice produced by the ice making assembly 22.

Although FIG. 1 shows a refrigerator 10 which includes a freezer compartment 16 disposed beside a fresh food compartment 14, the refrigerator 10 may have compartments arranged according to other configurations without departing from the scope of the invention. For example, the fresh food compartment 14 may be vertically disposed below the freezer compartment 16 or the freezer compartment 16 may be vertically disposed below a fresh food compartment 14.

Figure 2:
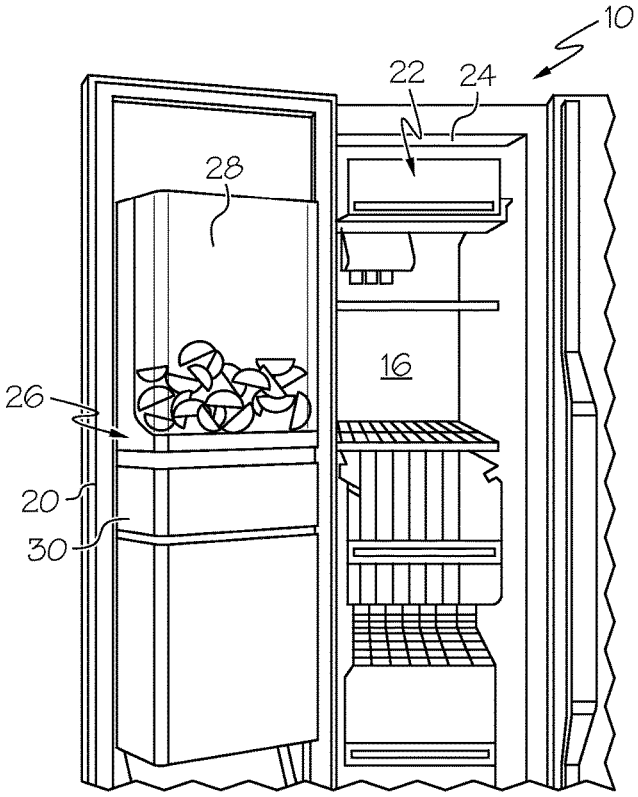
FIG. 2 is a fragmentary perspective view illustrating an ice making and dispensing system within a compartment of the refrigerator of FIG. 1.

FIG. 2 shows an ice making and dispensing system within a compartment of the refrigerator. The illustrated embodiment shows an ice making assembly 22 disposed within the freezer compartment 16. The ice making assembly 22 can be mounted to the inside surface of the top wall 24 of the freezer compartment 16. An ice dispensing system 26, mounted to the freezer door 20, can be configured to be positioned below the ice making assembly 22 for receiving ice pieces therefrom when the freezer door 20 can be in a closed position. The ice dispensing system 26 includes an ice storage receptacle, bucket or bin 28, also collectively herein referred to as an ice storage unit. When operated, the ice dispensing system 26 transfers ice pieces from the ice bucket 28 through the freezer door 20 whereby ice pieces may be dispensed through a conventional, forwardly exposed ice dispenser station or external ice service area. Alternatively, a user may remove the ice bucket 28 from the freezer door 20. This allows a user to readily dispense a large quantity of ice from the ice bucket 28 into a receptacle, such as an insulated cooler.

Figure 3:
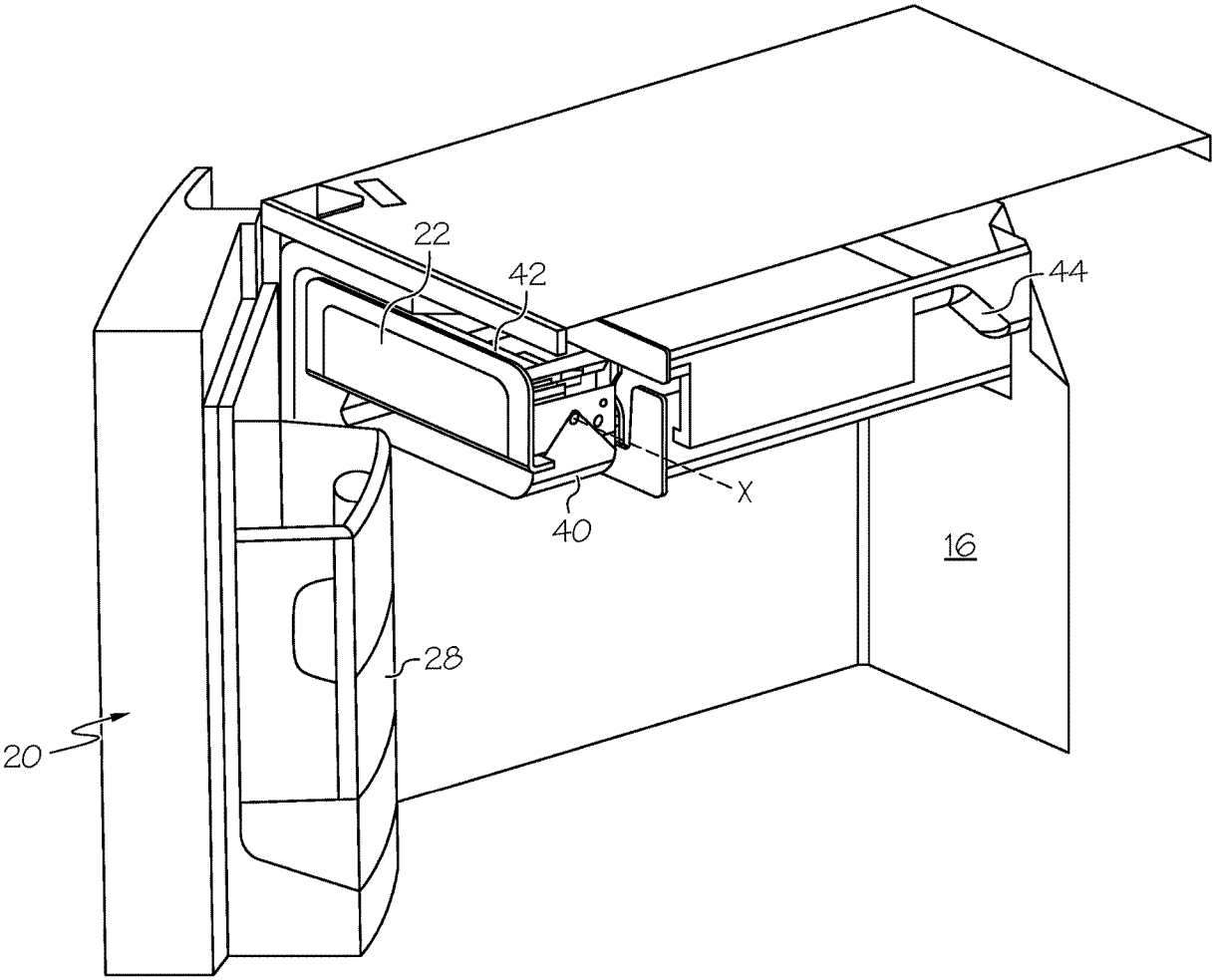
FIG. 3 is a perspective view of the ice making and dispensing system with the door in the open position.

FIG. 3 discloses details of the ice making and dispensing system when the refrigerator door is in an open position. The ice making assembly 22 includes an ice maker 42 for forming ice cubes. The ice making assembly 22 further includes a cover 40 that can be pivotally attached to the ice maker 42. The cover 40 may be connected to the ice maker 42 by, for example, a hinge, or a pivot pin, or slotted tab and pin or any other features of the sorts. The cover 40 may be formed of metal, plastic or any other suitable material. The cover 40 guides the discharge of ice. The cover 40 also protects the ice maker 42. When the freezer door 20 is in an open position, the cover 40 inhibits users from accessing the ice maker 42. When the freezer door 20 is in a closed position, the cover 40 exposes the ice maker 42 to the ice bucket 28. The ice maker assembly 22 also includes an air duct 44 disposed along the top surface 24 of the freezer compartment 16 to carry cold air to the ice maker 42.

The cover 40 can be pivotally connected to the sides of the ice maker 42 such that it pivots about an axis X. When the freezer door 20 is in an open position, the cover 40 can be configured to, for example, inhibit ice harvesting. Additionally, the cover 40 may inhibit ice from harvesting when the ice bucket 28 is removed from the door 20. When a user opens the freezer door 20 or removes the ice bucket 28 from the freezer door 20, the cover 40 is released from the edge of the ice bucket 28 causing the cover 40 to swing about the horizontal axis into a freely hanging position below the icemaker 42, thus inhibiting additional ice from being harvested.

Figure 4:
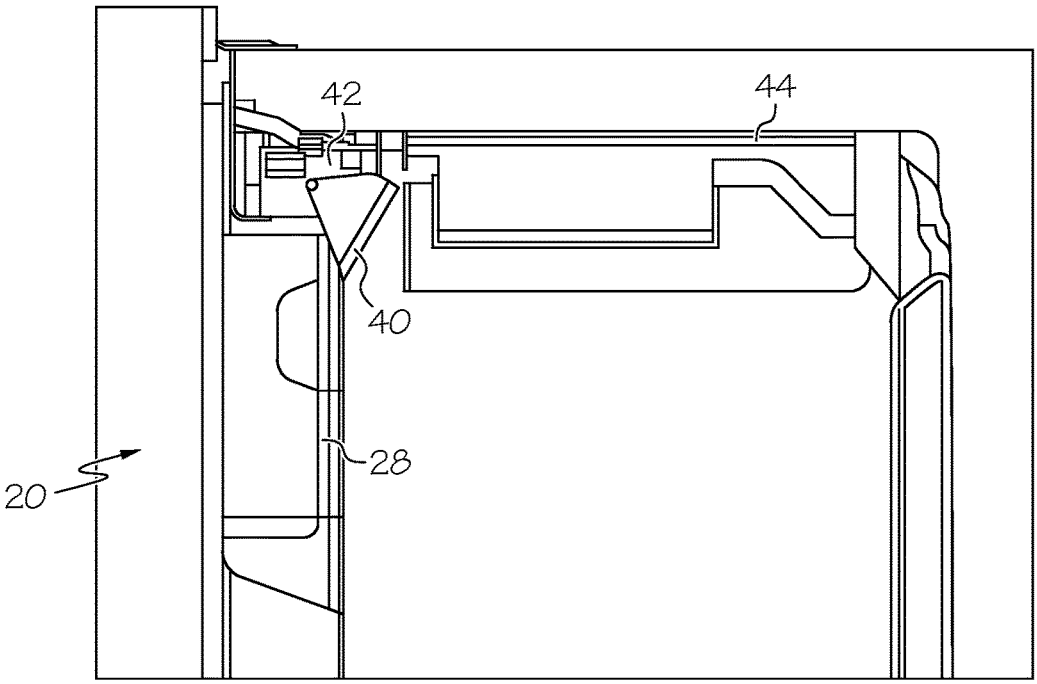
FIG. 4 is a side view of an ice making and dispensing system with the door in the closed position.
Figure 5:
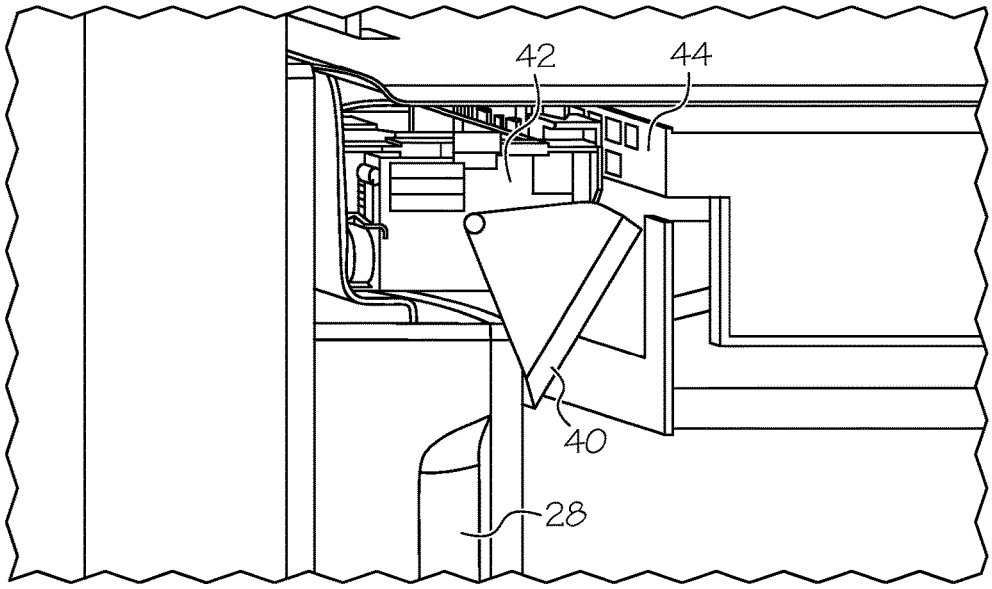
FIG. 5 is a fragmentary perspective view of the ice making and dispensing system within a compartment of FIG. 4.

Turning now to FIGS. 4 and 5, when the freezer door 20 is in a closed position, the cover 40 swivels about the axis X to push against the edge of the ice bucket 28 causing the cover 40 to swing upward and aside to expose the ice maker 42 to the ice bucket 28 so that ice cubes can fall directly into the ice bucket 28 from the ice maker 42 during harvesting.

Figure 6:
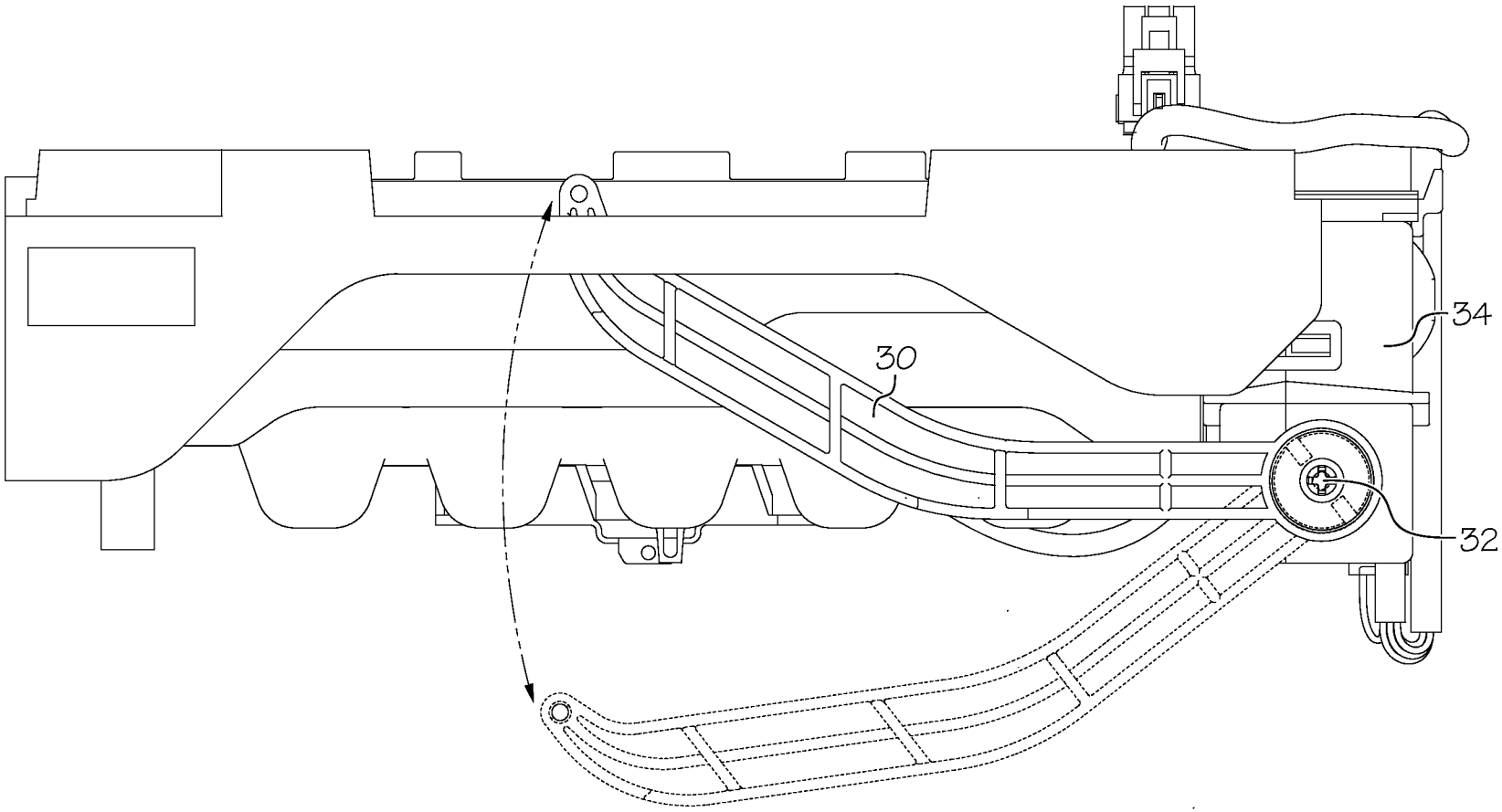
FIG. 6 is side view of an exemplary embodiment of a bail arm for the ice making and dispensing system.
Figure 7:
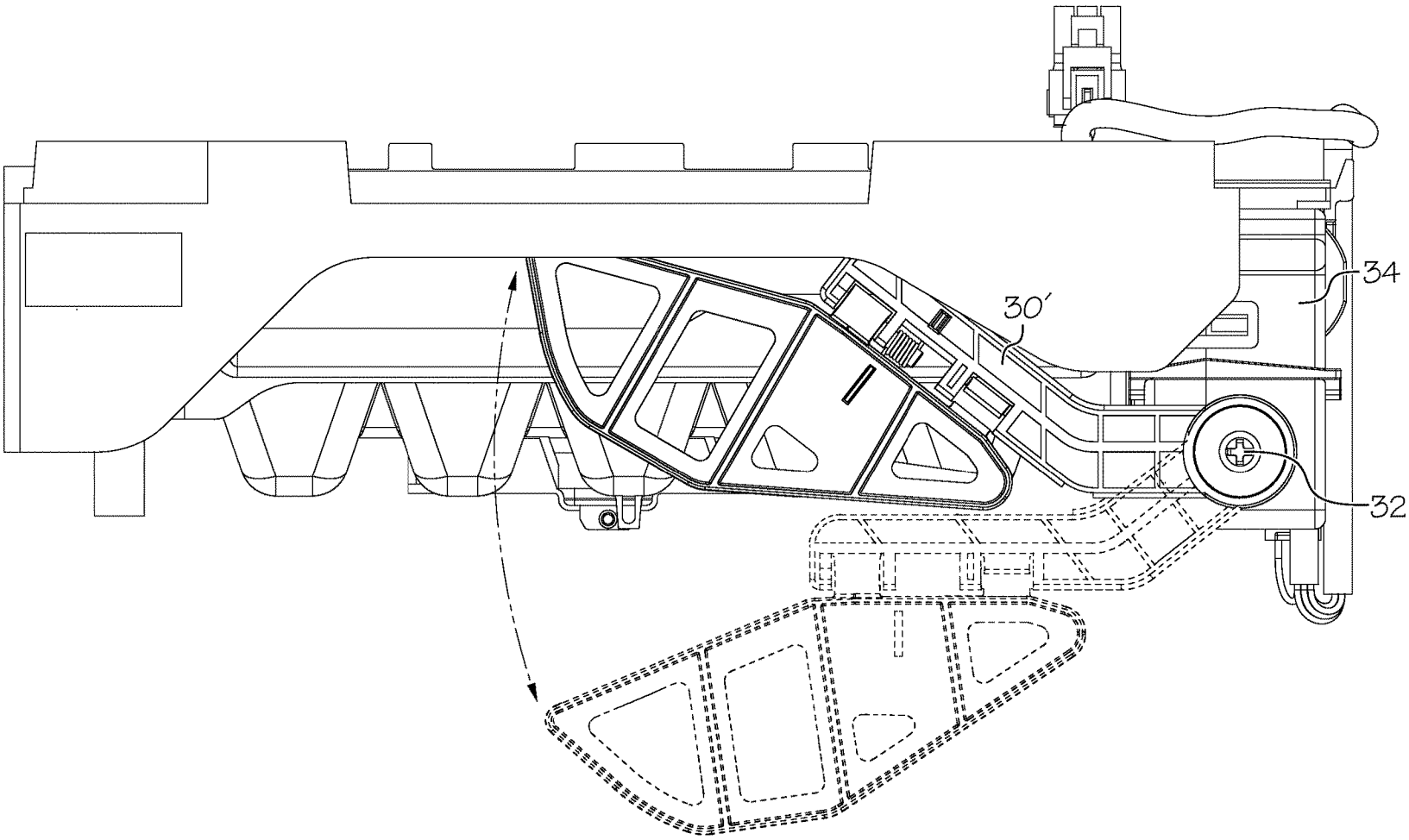
FIG. 7 is side view of another exemplary embodiment of a bail arm for the ice making and dispensing system.

In FIGS. 5 and 6 show example embodiments of a bail arm. The bail arm 30 can be operatively connected to the ice maker 42 for sensing the level of ice in the ice bucket 28. The bail arm 30 may be attached to the end of a shaft 32 which protrudes from the side of the ice maker's control housing 34. The bail arm 30 may be positioned on either side of the housing as may be appropriate for different refrigerator configurations. The bail arm 30 may be keyed to the end of the shaft 32 so that the bail arm 32 cannot rotate independently of the shaft. The bail arm 30 may be held in place by a single screw.

In operation, the bail arm 30 transitions between an ice sensing position and an ice harvest position for ice harvest by the ice maker. When the freezer door 20 is in a closed position, the bail arm 30 rotates into the ice bucket 28 to determine if the ice bucket 28 is full and/or if harvesting of ice is necessary. Upon sensing the level of the ice, Ice cubes may fall directly into the ice bucket 28 from the ice maker 42 during harvesting if the bail arm 30 determines that the ice bucket 28 is not full. If the bail arm 30 determines that the ice bucket 28 is full, the bail arm signals the icemaker to stop harvesting ice. The bail arm may swing up and into a lock position to inhibit ice from harvesting. If the ice bucket 28 is not in place when the freezer door 20 is closed, the cover 40 will not be pushed aside causing the cover 40 to block the bail arm 30 so that the ice maker 42 will be inhibited from harvesting ice.

Figure 8:
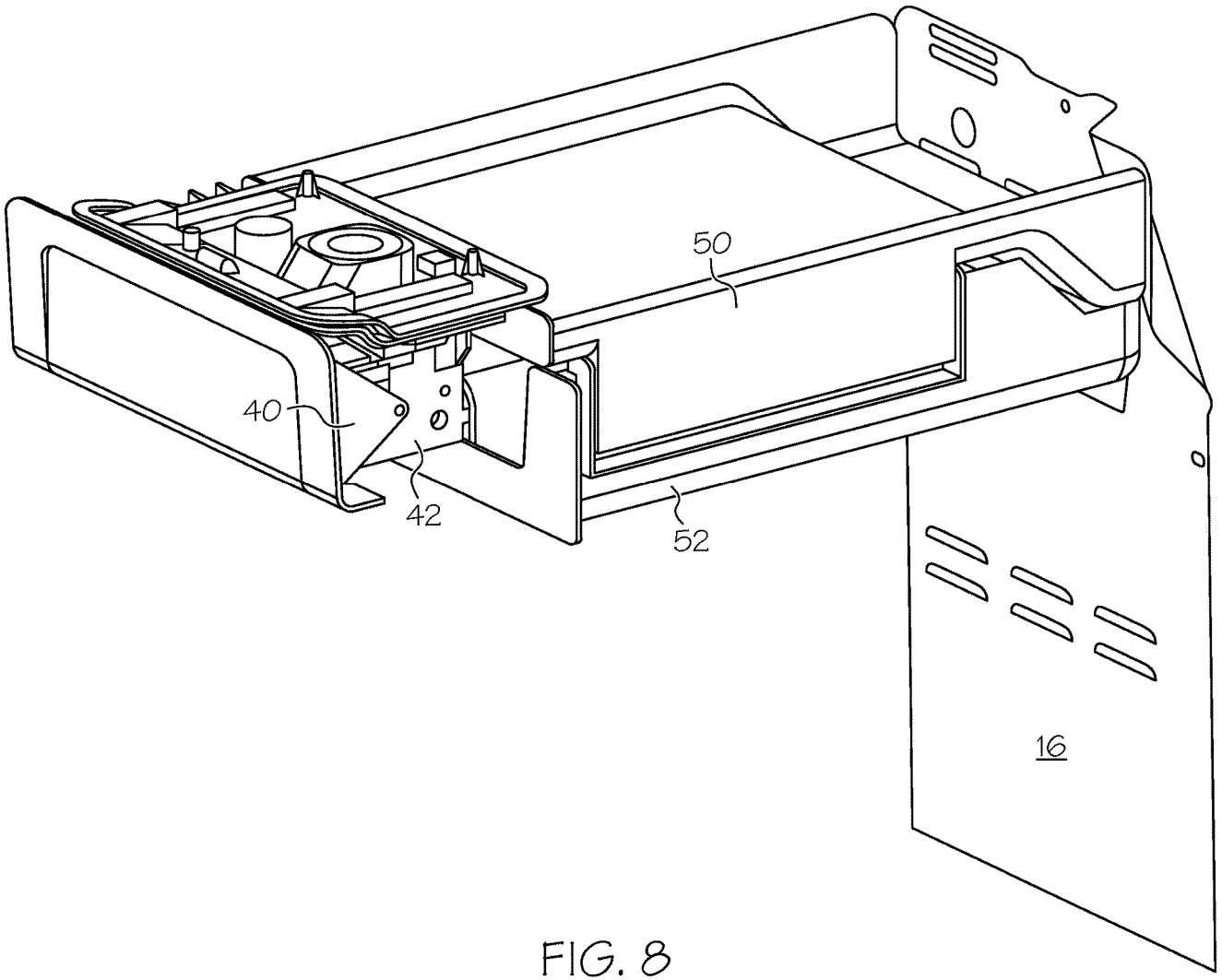
FIG. 8 is perspective view of an exemplary embodiment of a storage chamber of a refrigerator having an ice making and dispensing system in its closed position.
Figure 9:
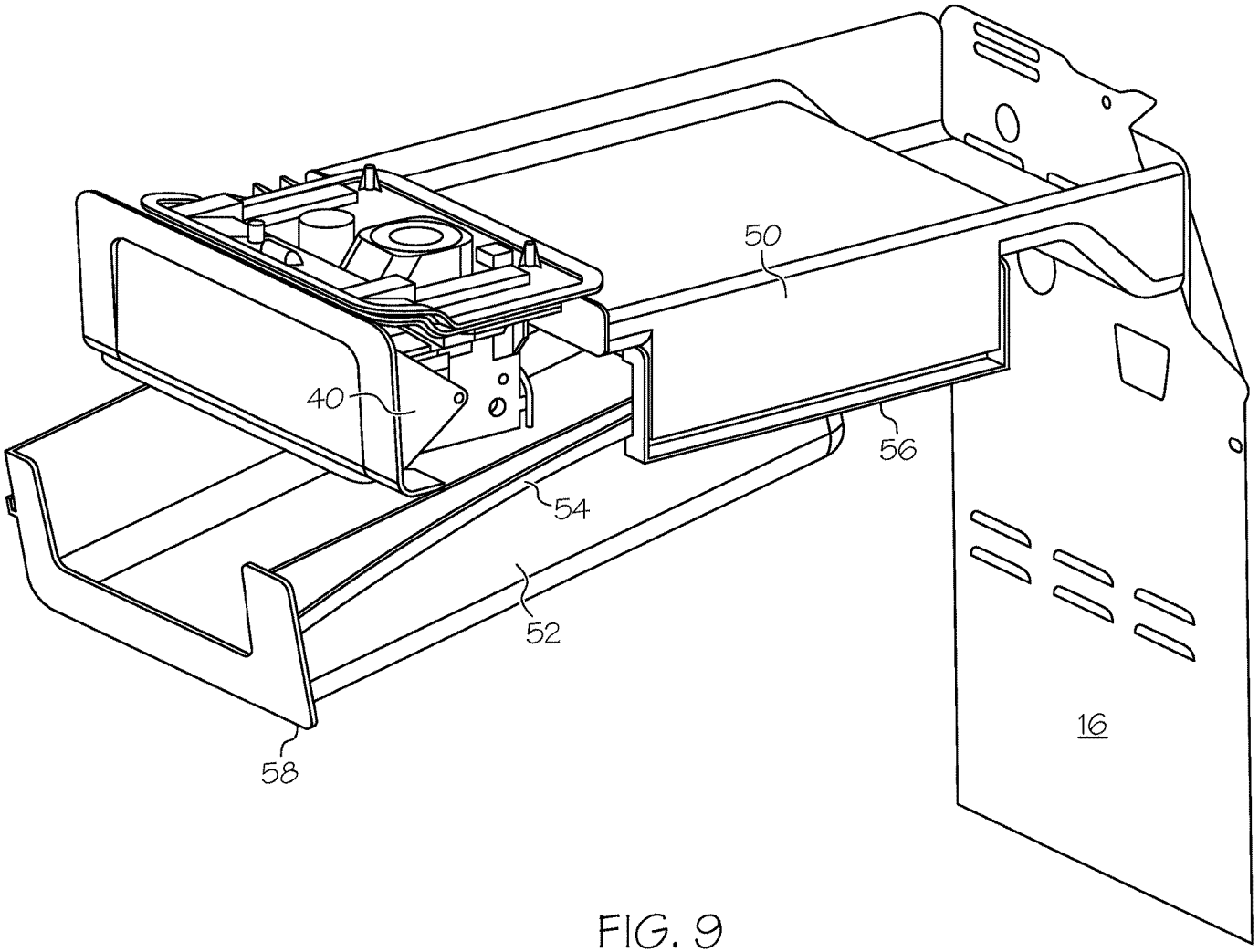
FIG. 9 is perspective view of the storage chamber in FIG. 8 in its open position.

FIGS. 8 and 9 illustrate an example embodiment of the storage chamber in its closed and in its open position, respectively. A storage chamber 50 can be disposed behind the ice maker 42 enclosing a space underneath the air duct 44. The storage chamber 50 includes a slidable tray 52 defining a storage space behind the ice maker when the tray is in a closed position. The tray 52 can be configured to be slidably pushed in and pulled out of the freezer compartment 16 in such a manner that the tray 52 can be slid to an accessible position under the ice maker 42 without disturbing the cover 40 or the ice maker 42. The tray 52 slides downwardly underneath the ice maker 42 as it is pulled out to its accessible position allowing a user to place items in the tray 52 so that those items will be stored in the storage chamber 50 when the tray is pushed back to its closed position. Pulling the tray 52 out to its accessible position exposes the items in the tray so that they may be removed by a user.

The tray 52 includes a pair of curved guides 54 located along opposing side walls of the tray. The curved guides 54 slidably engage guide tracks 56 formed along the sidewalls of the storage chamber 50. By this arrangement the tray 52 is slidably supported in both its accessible and closed positions. The curved guides 56 define a curved path enabling the tray 54 to follow the curved path when pulled out. The curved path enables the tray 54 to slide downward and underneath the ice maker 42 as it is pulled out. The front surface 58 of the tray 54 can be adapted to serve as a handle for pulling out and pushing in the tray 54. The front surface can have an upwardly opening C shape defined by an opening for facilitating access to items in the tray.

The present disclosure has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

PARTS LIST

10—Refrigerator
12—Cabinet
14—Fresh Food Compartment
16—Freezer Compartment
18—Fresh Food Door
20—Freezer Door
22—Ice Making Assembly
24—Top Wall
26—Ice Dispensing System
28—Ice Bucket
30—Bail Arm
40—Cover
42—Ice Maker
44—Air Duct
50—Storage chamber
52—Sliding Tray
54—Curved Guide
56—Sliding Guide
58—Front Surface

What is claimed is:

1. A refrigerator including a compartment, the refrigerator comprising:

a door configured to open and close at least a portion of the compartment, an ice making assembly disposed within the compartment, the ice making assembly having an ice maker for forming ice pieces, and a cover movably coupled to the ice maker, wherein the cover is moveable between an unrestricting position which allows the ice maker to harvest the ice pieces, and a restricting position which prevents the ice maker from harvesting the ice pieces;

an ice storage unit removably mounted to the door for receiving ice pieces from the ice making assembly, wherein when the door is in an open position, the cover inhibits access to the ice maker, and when the door is in a closed position, the cover exposes the ice maker to the ice storage unit; and a bail arm movably mounted to the ice maker between an ice sensing position and an ice harvest position for sensing a level of ice within the ice storage unit, wherein the bail arm is operatively configured to inhibit the ice maker from harvesting ice pieces when the ice storage unit is full, and wherein when the cover is in the restricting position, the cover restricts movement of the bail arm to the ice sensing position to thereby inhibit the ice maker from harvesting ice pieces.

2. The refrigerator of claim 1, wherein when the cover is in the unrestricting position, the cover permits movement of the bail arm into the ice storage unit and towards the ice harvest position.

3. The refrigerator of claim 2, wherein if the ice storage unit is not full and the bail arm traverses to the ice harvest position, the ice maker is permitted to harvest and transfer the ice pieces into the ice storage unit.

4. The refrigerator of claim 1, wherein the cover is rotatably hinged to a side wall of the ice maker.

5. The refrigerator of claim 1, wherein the cover rotates about a horizontal axis relative to the ice maker.

6. The refrigerator of claim 1, wherein the cover is movably coupled to the ice maker by a slotted tab and pin.

7. The refrigerator of claim 1, wherein at least a portion of the ice storage unit is configured to be positioned under the ice making assembly when the door is in a closed position.

8. The refrigerator of claim 1, wherein the cover in the unrestricting position engages a top edge of the ice storage unit.

9. The refrigerator of claim 8, wherein when the door is in the closed position and the ice storage unit is removed from the door, the cover remains in the restricting position to prevent the ice maker from harvesting the ice pieces.

10. The refrigerator of claim 1, wherein the bail arm is further moveable to a lock position to inhibit ice pieces from harvesting.

* * * * *